US012209777B2

(12) United States Patent
Sishtla et al.

(10) Patent No.: US 12,209,777 B2
(45) Date of Patent: Jan. 28, 2025

(54) MAGNETIC BEARING COMPRESSOR PROTECTION

(71) Applicant: Carrier Corporation, Palm Beach Gardens, FL (US)

(72) Inventors: Vishnu M. Sishtla, Manlius, NY (US); Jun Cao, Shanghai (CN); Kai Deng, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 148 days.

(21) Appl. No.: 17/305,180

(22) Filed: Jul. 1, 2021

(65) Prior Publication Data

US 2022/0011026 A1 Jan. 13, 2022

Related U.S. Application Data

(60) Provisional application No. 62/705,599, filed on Jul. 7, 2020.

(51) Int. Cl.
*F25B 13/00* (2006.01)
*F25B 49/02* (2006.01)

(52) U.S. Cl.
CPC ..... *F25B 13/00* (2013.01); *F25B 49/022* (2013.01); *F25B 2400/077* (2013.01); *F25B 2600/0251* (2013.01); *F25B 2600/0253* (2013.01)

(58) Field of Classification Search
CPC ..... F25B 49/022; F25B 2400/077; F25B 2600/0251; F25B 2600/0253
See application file for complete search history.

(56) References Cited

U.S. PATENT DOCUMENTS

2012/0000222 A1* 1/2012 Fink ..... F25D 29/003 62/157
2014/0241909 A1* 8/2014 Perevozchikov ..... F04C 23/001 417/244

(Continued)

FOREIGN PATENT DOCUMENTS

CN 109855338 A * 6/2019
JP H04127895 U 11/1992

(Continued)

OTHER PUBLICATIONS

Liu, "Air-cooling magnetic suspended centrifugal unit and its halt control method" 2019, Full document (Year: 2019).*

(Continued)

*Primary Examiner* — Nael N Babaa
(74) *Attorney, Agent, or Firm* — Souad Hakim

(57) ABSTRACT

A vapor compression system and method for operating the vapor compression system are provided. The vapor compression system includes a first compressor, a second compressor, a condenser, and at least one check valve disposed between the first compressor and the condenser. The method provides for the transmitting of a shutdown command to at least one of the first compressor and the second compressor, at least one of the first compressor and the second compressor including a rotating shaft and a magnetic bearing, the magnetic bearing having an active mode and an inactive mode, the magnetic bearing levitating the rotating shaft in the active mode. The method further provides for the monitoring of at least one of a rotational speed of the rotating shaft and a differential pressure over the check valve for a preset time, wherein the magnetic bearing remains in the active mode at least during the preset time.

10 Claims, 3 Drawing Sheets

(56) References Cited

U.S. PATENT DOCUMENTS

| | | | | |
|---|---|---|---|---|
| 2015/0007591 | A1* | 1/2015 | Liu | G01K 13/02 62/77 |
| 2015/0198353 | A1* | 7/2015 | Platt | F25D 23/006 62/298 |
| 2020/0096220 | A1* | 3/2020 | Nakazawa | H02P 5/747 |

FOREIGN PATENT DOCUMENTS

| | | | |
|---|---|---|---|
| JP | 2000205259 | A | 7/2000 |
| WO | 2009142659 | A1 | 11/2009 |
| WO | 2019199662 | A1 | 10/2019 |

OTHER PUBLICATIONS

Extended European Search Report received for EP Application No. 21184195.2 , mailed on Nov. 16, 2021, 07 Pages.

* cited by examiner

MAGNETIC BEARING COMPRESSOR PROTECTION

CROSS REFERENCE TO A RELATED APPLICATION

The application claims the benefit of U.S. Provisional Application No. 62/705,599 filed Jul. 7, 2020, the contents of which are hereby incorporated in their entirety.

BACKGROUND

Vapor compression systems (e.g., chillers) commonly include at least one compressor, a condenser, an expansion valve, and an evaporator. Refrigerant circulates through the vapor compression system in order to provide cooling to a medium (e.g., air). The refrigerant exits the compressor(s) through the discharge port(s) at a high pressure and a high enthalpy. The refrigerant then flows through the condenser at a high pressure and rejects heat to an external fluid medium. The refrigerant then flows through the expansion valve, which expands the refrigerant to a low pressure. After expansion, the refrigerant flows through the evaporator and absorbs heat from another medium (e.g., air). The refrigerant then re-enters the compressor(s) through the suction port(s), completing the cycle.

Compressors commonly include a motor rotor and a motor stator housed within a compressor housing. The rotor is fixed to and rotates with a rotating shaft, and the stator is fixed inside the compressor housing. Depending on the type of compressor, magnetic bearings may be used to levitate the rotating shaft while the compressor is operational. Touchdown bearings are commonly used by compressors with magnetic bearings to provide for smooth rotation of the shaft and protect the rotor when the compressor is shutdown. The touchdown bearings can be in the form of ball bearings or sleeve bearings. These touchdown bearings have potential to become damaged if the rotating shaft is placed on the touchdown bearings while the rotating shaft is still rotating, as the touchdown bearings are traditionally not lubricated.

When multiple compressors are incorporated (e.g., where at least one compressor is shutdown while at least one other compressor remains operational), there is potential for the pressure generated by an operational compressor to cause the rotating shaft of a compressor that is shutdown to continue to rotate even after being shutdown. Traditionally this problem is solved using one or more check valves. For example, a check valve may be placed between a compressor that has the potential to be shutdown (e.g., based on the load requirements) and the condenser and/or a compressor that may remain operational. However, if the check valve fails, the compressor that remains operational may prevent the rotating shaft of the compressor being shutdown from stopping. As mentioned above, if the rotating shaft is placed on the touchdown bearings while the rotating shaft is still rotating, the touchdown bearings will likely be damaged.

Accordingly, there remains a need for a way to prevent or at least mitigate the rotating shaft of a compressor being shutdown from being placed on the touchdown bearings while still rotating.

BRIEF DESCRIPTION

According to one embodiment, a method of operating a vapor compression system including a first compressor, a second compressor, a condenser, and at least one check valve disposed between the first compressor and the condenser is provided. The method includes a step for transmitting a shutdown command to at least one of the first compressor and the second compressor, at least one of the first compressor and second compressor including a rotating shaft and a magnetic bearing. The magnetic bearing including an active mode and an inactive mode. The magnetic bearing levitating the rotating shaft in the active mode. The method includes a step for monitoring at least one of a rotational speed of the rotating shaft and a differential pressure over the check valve for a preset time, wherein the magnetic bearing remains in the active mode at least during the preset time.

In accordance with additional or alternative embodiments, the preset time is less than ten minutes after the shutdown command is transmitted.

In accordance with additional or alternative embodiments, the method further includes a step for switching the magnetic bearing from the active mode to the inactive mode when the rotational speed reaches an acceptable threshold.

In accordance with additional or alternative embodiments, the acceptable threshold is less than 50 RPMs.

In accordance with additional or alternative embodiments, the method further includes a step for transmitting a shutdown command to the other of the first compressor or the second compressor when the rotational speed does not reach an acceptable threshold within the preset time.

In accordance with additional or alternative embodiments, the method further includes a step for activating an alarm when the rotational speed does not reach an acceptable threshold within the preset time.

In accordance with additional or alternative embodiments, the method further includes a step for closing an isolation valve disposed between the evaporator and at least one of the first compressor and the second compressor when the rotational speed does not reach an acceptable threshold within the preset time.

According to another aspect of the disclosure, a vapor compression system including a condenser, a first compressor a second compressor, a check valve, and a controller is provided. The condenser transfers heat from a working fluid to an external fluid medium. The first compressor and the second compressor are in fluid communication with the condenser. At least one of the first compressor and the second compressor include an electric motor, a magnetic bearing, and a touchdown bearing. The electric motor drives a rotating shaft. The magnetic bearing levitates the rotating shaft when in an active mode. The magnetic bearing is disposed adjacent to the electric motor. The touchdown bearing is configured to rotate and support the rotating shaft when the magnetic bearing is in an inactive mode. The touchdown bearing is disposed adjacent to the rotating shaft. The check valve is in fluid communication with the condenser and at least one of the first compressor and the second compressor. The controller is configured to control at least one of the first compressor and the second compressor. The controller is configured to receive a shutdown command for at least one of the first compressor and the second compressor. The controller is in communication with at least one sensor disposed within at least one of the first compressor and the second compressor. The sensor is configured to monitor at least one of a rotational speed of the rotating shaft and a differential pressure over the check valve for a preset time. The controller maintains the magnetic bearing in the active mode at least during the preset time.

In accordance with additional or alternative embodiments, the preset time is less than ten minutes after the shutdown command is transmitted to the controller.

In accordance with additional or alternative embodiments, the controller switches the magnetic bearing from the active mode to the inactive mode when the rotational speed reaches an acceptable threshold.

In accordance with additional or alternative embodiments, the acceptable threshold is less than 50 RPMs.

In accordance with additional or alternative embodiments, the other of the first compressor or the second compressor is shutdown when the rotational speed does not reach an acceptable threshold within the preset time.

In accordance with additional or alternative embodiments, the controller activates an alarm when the rotational speed does not reach an acceptable threshold within the preset time.

In accordance with additional or alternative embodiments, the vapor compression system further includes an isolation valve disposed between the evaporator and at least one of the first compressor and the second compressor, the isolation valve configured to prevent the flow of the working fluid into the first compressor.

In accordance with additional or alternative embodiments, the isolation valve is a solenoid valve.

In accordance with additional or alternative embodiments, the isolation valve is in communication with the controller, the controller configured to close the isolation valve when the rotational speed of the rotating shaft of the first compressor does not reach an acceptable threshold within the preset time.

In accordance with additional or alternative embodiments, the external fluid medium includes at least one of: an air supply and a water supply.

In accordance with additional or alternative embodiments, the working fluid is a refrigerant.

BRIEF DESCRIPTION OF THE DRAWINGS

The subject matter, which is regarded as the disclosure, is particularly pointed out and distinctly claimed in the claims at the conclusion of the specification. The following descriptions of the drawings should not be considered limiting in any way. With reference to the accompanying drawings, like elements are numbered alike:

DETAILED DESCRIPTION

As will be described below, a vapor compression system capable of preventing or at least mitigating a rotating shaft from being placed on the touchdown bearings while still rotating, and a method of operating the vapor compression system in such a manner are provided. The vapor compression system includes a first compressor and a second compressor. Depending on the load requirements, one of the compressors may be shutdown while the other compressor remains operational. For example, at part load operation, the first compressor may be shutdown while the second compressor may remain operational. To stop backflow of the working fluid (e.g., a refrigerant) and pressure from the operational compressor (e.g., the second compressor) into the compressor (e.g., the first compressor) being shutdown a check valve may be used. Although the vapor compression system described herein includes a check valve, the vapor compression system described herein is less reliant on the check valve than traditional vapor compression systems because the vapor compression system described herein provides for the maintaining of the magnetic bearing in an active mode while monitoring at least one of a rotational speed of the rotating shaft and a differential pressure of the check valve after a compressor is shutdown.

Figure 1:
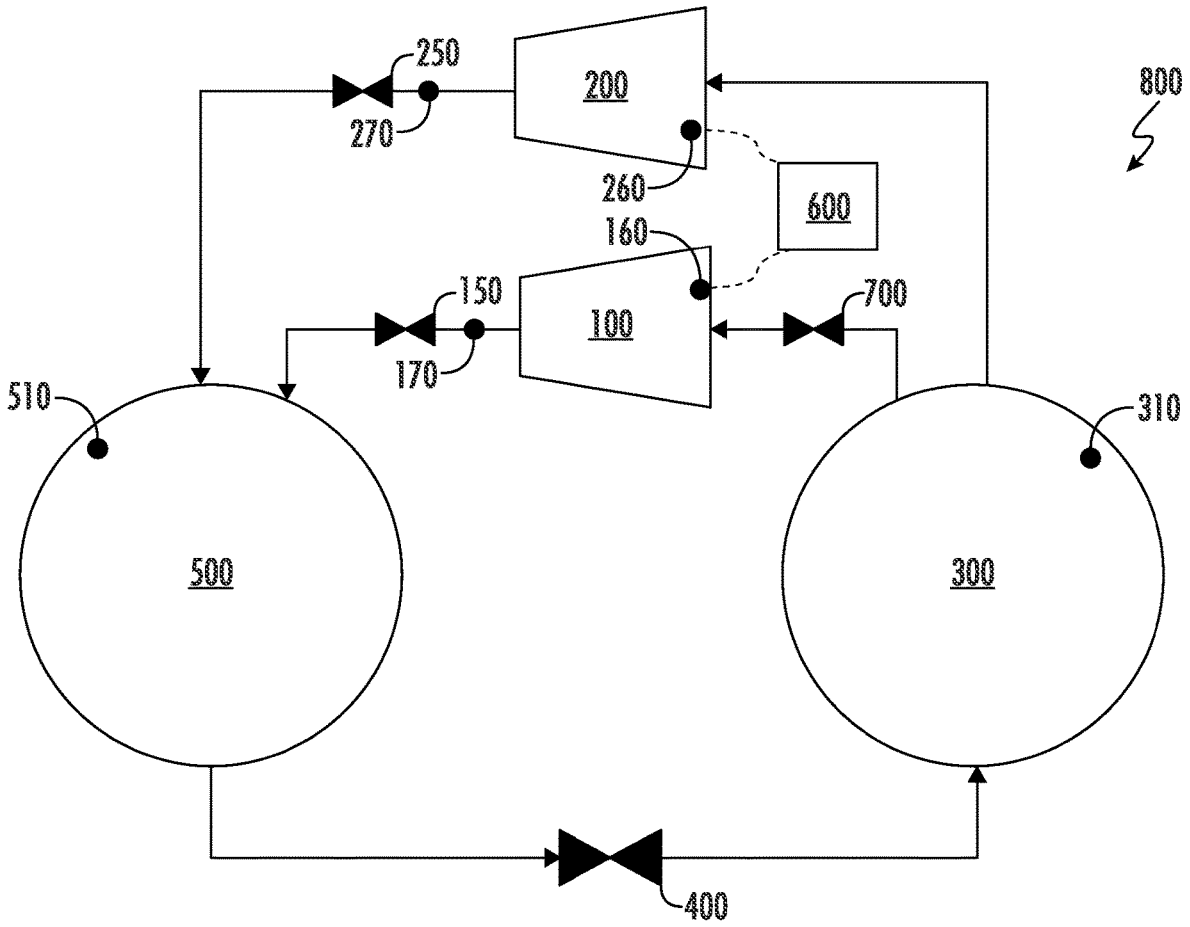
FIG. 1 is a schematic illustration of a vapor compression system including a condenser, a first compressor, and a second compressor, with a controller configured to control at least one of the first compressor and the second compressor, in accordance with one aspect of the disclosure.

With reference now to the Figures, a schematic illustration of a vapor compression system 800 including a condenser 500, a first compressor 100, and a second compressor 200 is shown in FIG. 1. It should be appreciated that the vapor compression system 800 may include any system (e.g., a chiller, etc.) with a condenser 500 and multiple compressors 100, 200, either of which include a rotating shaft 140 (shown in FIG. 2). As shown in FIG. 1 the vapor compression system 800 includes a controller 600 configured to control at least one of the first compressor 100 and the second compressor 200. As shown in FIG. 1, the vapor compression system 800 may include a first compressor 100, a second compressor 200, a condenser 500, an expansion valve 400, and an evaporator 300. The vapor compression system 800 may be configured to circulate a working fluid (e.g., a refrigerant such as R-134A) through the vapor compression system 800 to provide cooling to a medium (e.g., air, water, etc.). Although R-134A is mentioned, it will be appreciated that other types of refrigerant may be used.

As mentioned above, at times, the vapor compression system 800 may need to provide for a higher cooling capacity (which requires a higher compressed refrigerant flow), and at other time, a lower cooling capacity (which requires a lower compressed refrigerant flow). To provide continuous efficient supply of the desired amount of compressed refrigerant, the vapor compression system 800 includes a first compressor 100 and a second compressor 200. These compressors may be duplicates of the same compressor (e.g., being of the same size and configuration), or may be different (e.g., either sized differently or have different configurations). It is envisioned that at least one of the compressors (e.g., the first compressor 100) includes a magnetic bearing 110, a touchdown bearing 120, and a rotating shaft 140 (shown in FIG. 2).

Figure 2:
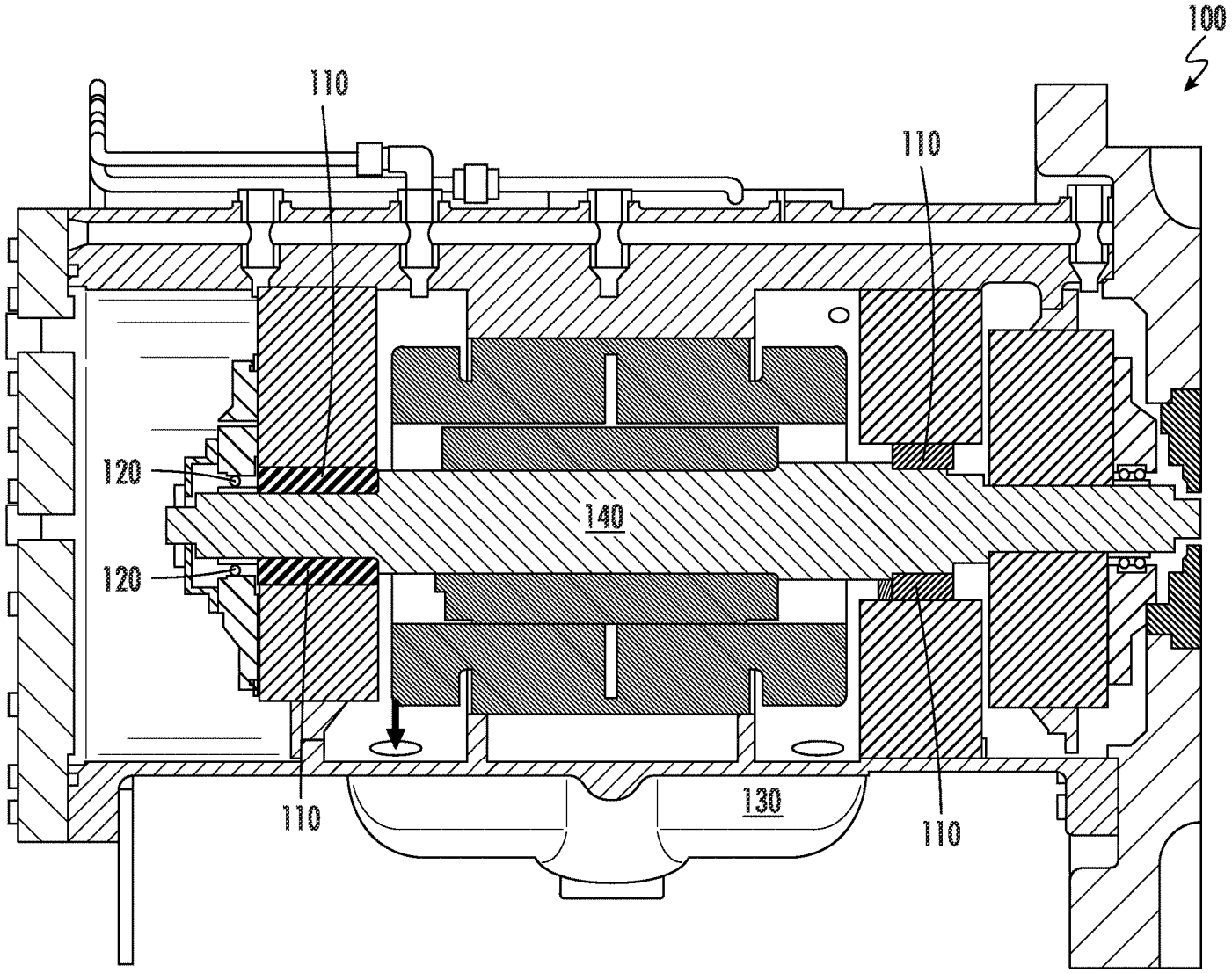
FIG. 2 is a cross-sectional side view of the first compressor shown in FIG. 1 depicting touchdown bearings disposed adjacent to a rotating shaft, in accordance with one aspect of the disclosure.

FIG. 2, depicts a cross-sectional side view of the first compressor 100 shown in FIG. 1. Although not shown, it should be appreciated that the second compressor 200 may be configured in the same manner as the first compressor 100. As shown in FIG. 2, the first compressor 100 includes an electric motor 130, a magnetic bearing 110, and a touchdown bearing 120. The electric motor 130 is used for driving a rotating shaft 140. The magnetic bearing 110 is used for levitating the rotating shaft 140 when in an active mode (e.g., at least when the first compressor 100 is operational). The first compressor 100 may be viewed as operational when the first compressor 100 is generating a positive pressure to force working fluid through the vapor compression system 800. It should be appreciated that the magnetic bearing 110 includes both an active mode (e.g., when generating a magnetic field for levitating the rotating shaft 140) and an inactive mode (e.g., when not generating a magnetic field). The magnetic bearing 110 is disposed adjacent to the electric motor 130. The touchdown bearing 120 is used for supporting the rotating shaft 140 when the magnetic bearing 110 is in an inactive mode. The touchdown bearing 120 is disposed adjacent to the rotating shaft 140.

As described above, the vapor compression system 800 may include a check valve 150 (shown in FIG. 1) in fluid communication with the first compressor 100 and the condenser 500. This check valve 150 may help to stop backflow of the working fluid second compressor 200 (e.g., when the second compressor 200 is operational) into the first compressor 100 when the first compressor 100 is being shutdown (e.g., when the vapor compression system 800 is operated at part load). This check valve 150 may also help to ensure the rotating shaft 140 of the first compressor 100 can stop rotating when the first compressor 100 is shutdown. As shown, in certain instances, both the first compressor 100 and the second compressor 200 may include check valves 150, 250, respectively.

To control at least one of the first compressor 100 and the second compressor 200, the vapor compression system 800 may include a controller 600 (shown in FIG. 1). The controller 600 may be configured to receive a shutdown command for the first compressor 100 (e.g., when part load operation is needed). It should be appreciated that the shutdown command may automatically be generated based on the input from one or more sensors (described below). The controller 600 may be in communication with at least one sensor for monitoring at least one of a rotational speed of the rotating shaft 140 (shown in FIG. 2) and a differential pressure over the check valve 150 for a preset time (e.g., for a period of time after the first compressor 100 is shutdown). The controller 600 may help prevent the rotating shaft 140 from being placed on the touchdown bearings 120 when the rotating shaft 140 is still rotating by maintaining the magnetic bearings 110 of the first compressor 100 in an active mode at least during the preset time. This present time, in certain instances, is less than ten (10) minutes after the shutdown command for the first compressor 100 is transmitted to and/or generated by the controller 600. For example, the preset time may be fewer than three (3) minutes after the first compressor 100 is shutdown.

The controller 600, in certain instances, may be viewed as a programmable logic controller (PLC) or programmable controller, capable of receiving inputs and outputs from one or more sensors (described below), and may include a processor (e.g., a microprocessor) and a memory for storing the programs to control components of the vapor compression system 800 (e.g., the operation of the first compressor 100 and/or the second compressor 200). The memory may include any one or combination of volatile memory elements (e.g., random access memory (RAM), non-volatile memory elements (e.g., ROM, etc.)), and/or have a distributed architecture (e.g., where various components are situated remotely from one another, but can be accessed by the processor). The controller 600 may be configured to switch the magnetic bearing 110 from the active mode to the inactive mode when the rotational speed of the rotating shaft 140 reaches an acceptable threshold. An acceptable threshold may be less than 50 RPMs. For example, when first compressor 100 is shutdown, the controller 600 may maintain the magnetic bearing 110 in an active mode (e.g., to keep the rotating shaft 140 levitated) until the rotating shaft 140 is rotating at less than 50 RPMs.

If the rotating shaft 140 remains rotating for a prolonged period of time (e.g., longer than the preset time, which may be ten (10) minutes after the first compressor 100 is shutdown), then the check valve 150 may have failed. A check valve 150 may be viewed to have failed when the check valve 150 does not prevent the working fluid and/or the pressure from entering the first compressor 100 when shutdown. The controller 600 may be configured to shutdown the second compressor 200 when the rotational speed of the rotating shaft 140 of the first compressor 100 does not reach an acceptable threshold within the preset time. It should be appreciated that the controller 600 may maintain the magnetic bearing 110 in an active mode (e.g., to keep the rotating shaft 140 levitated) following the shutdown of the second compressor 200 until the rotating shaft 140 is rotating at less than 50 RPMs. In addition to, or alternatively to, shutting down the second compressor 200, the controller 600 may be configured to activate an alarm (e.g., initiating a visual or audible signal) when the rotational speed of the rotating shaft 140 of the first compressor 100 does not reach an acceptable threshold with the preset time.

To monitor the rotational speed of the rotating shaft 140 and/or the differential pressure over the check valve 150, the controller 600 may be in communication with at least one sensor. In certain instances, the sensor is a rotational sensor 160 disposed in the first compressor 100. It should be appreciated that the controller 600 may also be in communication with a rotational sensor 260 disposed in the second compressor 200. The rotational sensor 160, 260 may include any technology capable of determining whether a rotating shaft 140 is rotating and/or at what RPM. For example, the rotational sensor 160, 260 may be a torque sensor or a transducer which convert torque into an electrical signal, which may be transmitted (e.g., through one or more wired or wireless connections) to the controller 600.

In certain instances, the sensor is a pressure sensor 170, 270, 510 disposed on either side of the check valve 150. For example, the vapor compression system 800 may include a pressure sensor 170 between the check valve 150 and the first compressor 100, a pressure sensor 270 between the check valve 250 and the second compressor 200, and/or a pressure sensor 510 disposed in the condenser 500. It should be appreciated that the vapor compression system 800 may also include a pressure sensor 310 disposed in the evaporator 300. Regardless of where located, the pressure sensor 170, 270, 510, 310 may include any technology capable of determining an internal pressure (e.g., in a conduit or a vessel). For example, the pressure sensor 170, 270, 510, 310 may be a strain gage-based transducer which converts pressure into an electrical signal, which may be transmitted (e.g., through one or more wired or wireless connections) to the controller 600. The controller 600 may use the pressure readings taken by the pressure sensors 170, 270, 510, 310 to calculate a differential pressure over the check valve 150. This differential pressure may be used to determine if a check valve 150 is operating correctly (e.g., not failed). For example, if the check valve 150 is closed between the first compressor 100 and the condenser 500 and the second compressor 200 is operational, then there should be a higher pressure reading downstream of the check valve 150 (e.g., from the pressure sensor 510 in the condenser 500) than upstream of the check valve 150 (e.g., from the pressure sensor 170). If the differential pressure is not higher than a minimum value (e.g., 100 psi) then the controller 600 may determine that the check valve 150 has failed.

To protect the first compressor 100 in the event of a failed check valve 150, the vapor compression system 800 may include an isolation valve 700 upstream and/or downstream of the first compressor 100. This isolation valve 700 may be configured to prevent the flow of the working fluid into the first compressor 100. This isolation valve 700, in certain instances, is a solenoid valve, which may be in communication with the controller 600. For example, the controller 600 may be configured to close the isolation valve 700 when the rotational speed of the rotating shaft 140 in the first compressor 100 does not reach an acceptable threshold within the preset time and/or when a differential pressure over the check valve 150 is below a minimum value (e.g., indicating the check valve 150 has failed). Once closed, the isolation valve 700 should allow the rotating shaft 140 of the first compressor 100 to slow down below the acceptable threshold. It should be appreciated that the controller 600 may maintain the magnetic bearing 110 in an active mode (e.g., to keep the rotating shaft 140 levitated) until the rotating shaft 140 is rotating at less than the acceptable threshold (e.g., 50 RPMs).

Figure 3:
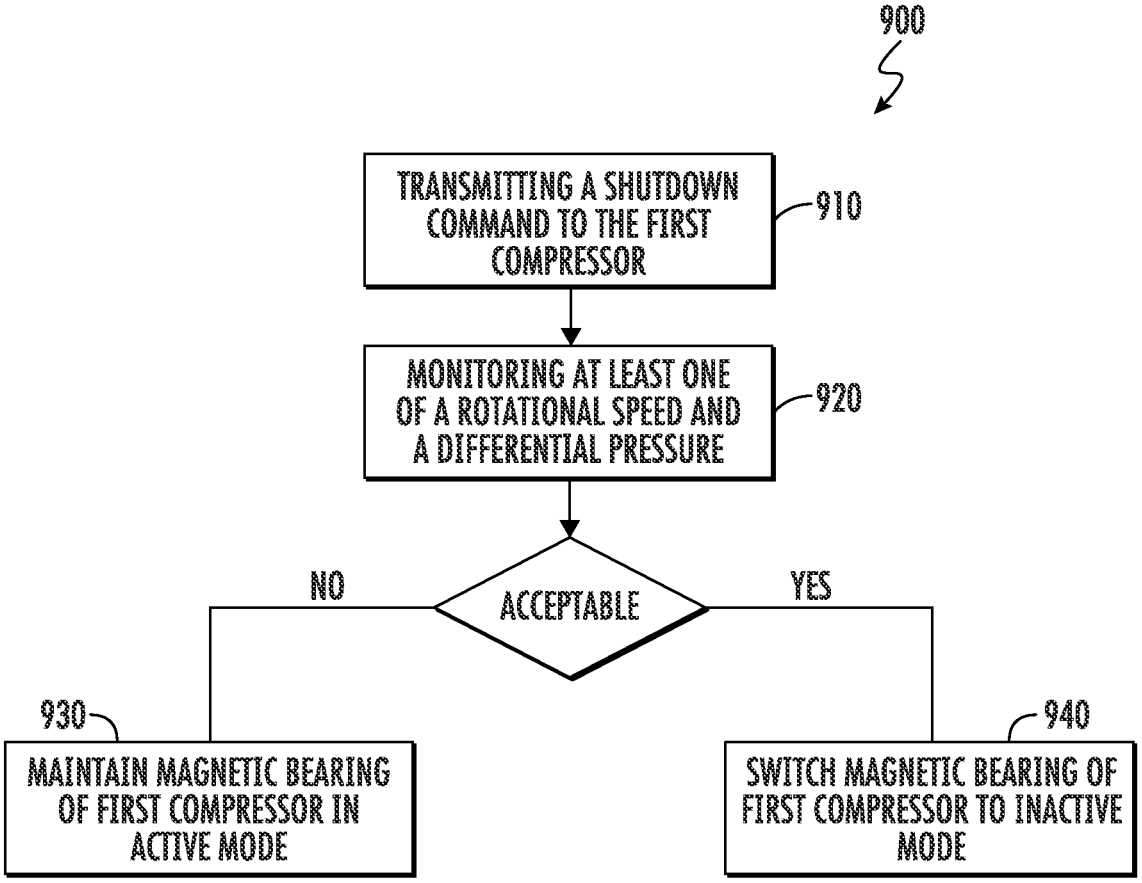
FIG. 3 is a flow diagram illustrating a method of operating a vapor compression system including a first compressor, a second compressor, a condenser, and at least one check valve disposed between the first compressor and the condenser, in accordance with one aspect of the disclosure.

This method of operating the vapor compression system 800 may help prevent, or at least mitigate, the touchdown bearings 120 of a compressor (e.g., the first compressor 100) being shutdown from becoming damaged. This method 900 may be completed by a controller 600 (e.g., such as the controller 600 described above). This method 900 is illustrated in FIG. 3. The method 900 may be performed, for example, using the exemplary vapor compression system 800 shown in FIG. 1, which may include the exemplary first compressor 100 shown in FIG. 2. As shown in FIG. 1, the vapor compression system may include a first compressor 100, a second compressor 200, a condenser 500, and at least one check valve 150 disposed between the first compressor 100 and the condenser 500. The method 900 provides step 910 of transmitting a shutdown command to the first compressor 100. The first compressor 100 including a rotating shaft 140 and a magnetic bearing 110. The magnetic bearing 110 including an active mode and an inactive mode. The magnetic bearing 110 configured to levitate the rotating shaft 140 in the active mode.

The method 900 provides step 910 of transmitting a shutdown command to the first compressor 100. The method 900 further provides step 920 of monitoring at least one of a rotational speed of the rotating shaft and a differential pressure over the check valve 150 for a preset time (e.g., than ten (10) minutes after the shutdown command is transmitted to the first compressor 100). As shown in FIG. 3, the method provide step 940 of switching the magnetic bearing 110 from the active mode to the inactive mode (e.g., to no longer levitate the rotating shaft 140) if the rotational speed reaches an acceptable threshold (e.g., less than 50 RPMs). However, if the rotational speed does not reach an acceptable threshold within the preset time then the method provides step 930 of maintaining the magnetic bearing 110 in the active mode (e.g., to remain levitating the rotating shaft 140), as the check valve 150 has likely failed. As described above, a failure of the check valve 150 may be confirmed by a differential pressure being less than a minimum value (e.g., 100 psi). If the check valve 150 has failed, the method 900 may provide for the additional steps of shutting down the second compressor 200, and/or shutting an isolation valve 700 to allow the rotational shaft 140 of the first compressor 100 to slow down below the acceptable threshold. It should be appreciated that the magnetic bearing 110 may stay in an active mode (e.g., to keep the rotating shaft 140 levitated) even after the second compressor 200 is shutdown and/or after the isolation valve 700 is closed (e.g., until the rotating shaft 140 is rotating at less than the acceptable threshold (e.g., 50 RPMs)).

The use of the terms "a" and "and" and "the" and similar referents, in the context of describing the invention, are to be construed to cover both the singular and the plural, unless otherwise indicated herein or cleared contradicted by context. The use of any and all example, or exemplary language (e.g., "such as", "e.g.", "for example", etc.) provided herein is intended merely to better illuminate the invention and does not pose a limitation on the scope of the invention unless otherwise claimed. No language in the specification should be construed as indicating any non-claimed elements as essential to the practice of the invention.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A vapor compression system, comprising:

a condenser for transferring heat from a working fluid to an external fluid medium;

a first compressor and a second compressor in fluid communication with the condenser, at least one of the first compressor and the second compressor comprising:

an electric motor for driving a rotating shaft;

a magnetic bearing for levitating the rotating shaft when in an active mode, the magnetic bearing disposed adjacent to the electric motor; and a touchdown bearing configured to rotate and support the rotating shaft when the magnetic bearing is in an inactive mode, the touchdown bearing disposed adjacent to the rotating shaft;

a check valve in fluid communication with the condenser and at least one of the first compressor and the second compressor;

a controller configured to control at least one of the first compressor and the second compressor, the controller configured to receive a shutdown command for one of the first compressor and the second compressor, the controller in communication with at least one sensor disposed within the compressor in shutdown, the sensor configured to monitor at least one of a rotational speed of the rotating shaft and a differential pressure over the check valve for a preset time, wherein the controller maintains the magnetic bearing in the active mode at least during the preset time and further wherein the controller is configured to put the other of the first compressor or the second compressor into shutdown when the rotational speed or the differential pressure over the check valve for the preset time does not reach an acceptable threshold within the preset time; and an isolation valve positioned between an evaporator and the first compressor, the isolation valve configured to prevent flow of the working fluid into the first compressor wherein the isolation valve is in communication with the controller, the controller configured to close the isolation valve when the rotational speed of the rotating shaft of the first compressor does not reach the acceptable threshold within the preset time.

2. The vapor compression system of claim 1, wherein the preset time is less than ten minutes after the shutdown command is transmitted to the controller.

3. The vapor compression system of claim 1, wherein the controller switches the magnetic bearing from the active mode to the inactive mode when the rotational speed reaches the acceptable threshold.

4. The vapor compression system of claim 3, wherein the acceptable threshold is less than 50 RPMs.

5. The vapor compression system of claim 1, wherein the controller activates an alarm when the rotational speed does not reach the acceptable threshold within the preset time.

6. The vapor compression system of claim 1, wherein the isolation valve is a solenoid valve.

7. The vapor compression system of claim 1, wherein the external fluid medium is comprised of at least one of: an air supply and a water supply.

8. The vapor compression system of claim 1, wherein the working fluid is a refrigerant.

9. A vapor compression system comprising:

a condenser for transferring heat from a working fluid to an external fluid medium;

a first compressor and a second compressor in fluid communication with the condenser, at least one of the first compressor and the second compressor comprising:

an electric motor for driving a rotating shaft;

a magnetic bearing for levitating the rotating shaft when in an active mode, the magnetic bearing disposed adjacent to the electric motor; and a touchdown bearing configured to rotate and support the rotating shaft when the magnetic bearing is in an inactive mode, the touchdown bearing disposed adjacent to the rotating shaft;

a check valve in fluid communication with the condenser and at least one of the first compressor and the second compressor;

a controller configured to control at least one of the first compressor and the second compressor, the controller configured to receive a shutdown command for one of the first compressor and the second compressor, the controller in communication with at least one sensor disposed within the compressor in shutdown, the sensor configured to monitor at least one of a rotational speed of the rotating shaft and a differential pressure over the check valve for a preset time, wherein the controller maintains the magnetic bearing in the active mode at least during the preset time; and further comprising an isolation valve disposed between the evaporator and the compressor in shutdown, the isolation valve configured to prevent the flow of the working fluid into the compressor in shutdown;

wherein the isolation valve is in communication with the controller, the controller configured to close the isolation valve when the rotational speed of the rotating shaft of the compressor in shutdown does not reach an acceptable threshold within the preset time.

10. The vapor compression system of claim 9, wherein the isolation valve is a solenoid valve.

* * * * *